United States Patent [19]

Häusler et al.

[11] 4,262,715

[45] Apr. 21, 1981

[54] DECORTICATING DRUM WITH SELECTIVE PROCESSING MODE

[75] Inventors: Richard Häusler; Karl Krebs, both of Graz, Austria

[73] Assignee: Maschinenfabrik Andritz Actiengesellschaft, Austria

[21] Appl. No.: 962,648

[22] Filed: Nov. 21, 1978

[30] Foreign Application Priority Data

Nov. 23, 1977 [AT] Austria ..... 8369/77

[51] Int. Cl.[3] ..... B27L 1/02

[52] U.S. Cl. ..... 144/208 B; 134/122 R; 138/155; 144/311; 241/179; 285/373

[58] Field of Search ..... 241/179; 144/208 R, 144/208 B, 311; 285/235, 236, 376, 373; 138/99, 120, 121, 155; 405/135; 15/3.1, 3.12; 134/64, 122

[56] References Cited

U.S. PATENT DOCUMENTS

| | | | |
|---|---|---|---|
| 1,457,487 | 6/1923 | Bartley | 144/208 B |
| 1,798,459 | 3/1931 | Elmore et al. | 144/208 B |
| 2,349,016 | 5/1944 | Stephens | 138/120 X |
| 3,154,328 | 10/1964 | Masse | 285/373 X |
| 3,286,746 | 11/1966 | Eriksson | 144/208 B |
| 3,315,991 | 4/1967 | Davis | 138/99 X |
| 3,495,853 | 2/1970 | Furrer | 285/373 X |
| 3,860,742 | 1/1975 | Medney | 138/155 |
| 4,176,865 | 12/1979 | Felton et al. | 285/373 |

*Primary Examiner*—W. Donald Bray
*Attorney, Agent, or Firm*—James E. Bryan

[57] ABSTRACT

An improved decorticating drum with a selective mode of processing is disclosed, composed of a hollow cylinder horizontally resting on support rollers and being rotatable about its longitudinal axis, being adapted to receive wood fed in at one end and discharge it at the other, in particular a decorticating drum for dry debarking including longitudinal slots at the surface thereof for the elimination of the bark, the improvement comprises detachable covers in the region of the longitudinal slots whereby a wet decorticating drum may be formed, said covers resting against the outer surface of the drum.

3 Claims, 2 Drawing Figures

DECORTICATING DRUM WITH SELECTIVE PROCESSING MODE

This invention relates to a decorticating drum with a selective mode of processing, composed of a hollow cylinder resting on support rollers and rotatable about its longitudinal axis, loading taking place at one end and the wood being removed at the other, the invention relating in particular to decorticating drums for dry debarking including longitudinal slots at the surface for evacuating the bark.

It is known to design decorticating drums which are primarily intended for dry decortication. These are specially supported hollow cylinders, the wood trunks being introduced at one end and the decorticated trunks being removed at the other. In order to continuously remove the bark during the actual operation, openings are provided at the surface from which the wastes, generally in the form of bark flour, drop as the drum turns. Decorticating drums are also known which include an opening at the surface for the loading and the removal of the material to be decorticated. This latter design however is cited only in the interest of completeness, being of slight relevance to the invention.

A further process is known, called "wet decortication", the wood to be debarked being processed while additionally introducing water into the drum in order to be capable of properly decorticating even very dessicated wood trunks. The design of the drum in this case is approximately the same, however slots at the drum surface must be avoided as otherwise the water would at once drain downwardly. Again, the end faces of the decorticating drum must be sealed water-tight in order to retain the decorticating water in the drum during processing.

These two processing modes for decorticating wood trunks are known and are used depending upon the kind of wood present. However there is a drawback in that the wood intended for decortication in a given and present drum may be unavailable, and, therefore, the wood must first be pretreated using additional equipment.

The object of the invention is to provide a decorticating drum with selective processing modes and composed of a hollow cylinder resting on support rollers and rotatable about its longitudinal axis, the wood being fed in at one end and removed at the other, in particular a decorticating drum for dry debarking including longitudinal slots at its surface for the elimination of the bark. It is desired that using such a decorticating drum, the material to be decorticated be readily processable without pretreatment. This is achieved by the invention in that detachable covers are mounted in the region of the longitudinal slots for the purpose of forming a wet decorticating drum, the covers lying water-tight against the outer surface of the drum. To achieve simple sealing of the longitudinal slots, a further embodiment of the invention provides that the covers are composed of a pair of rings and a seal, the pair of rings being tightly secured to the drum at the ends of the longitudinal slots and being hermetically joined by an O-ring, the ring proper being mounted by screws or a quick-connect means to the pair or rings.

Because of this special design of a decorticating drum, it is now feasible to obtain in a simple manner both a dry and a wet decorticating drum. Accordingly, no more is required than mounting the covers using screws and sealing elements in the region of the longitudinal slots, and to close these covers, to make a dry decorticating drum a wet one. If a wood of a different nature is to be debarked, however, then no more is required for processing than removing the covers.

The invention will be further illustrated by reference to the accompanying drawings in which.

Figure 1:
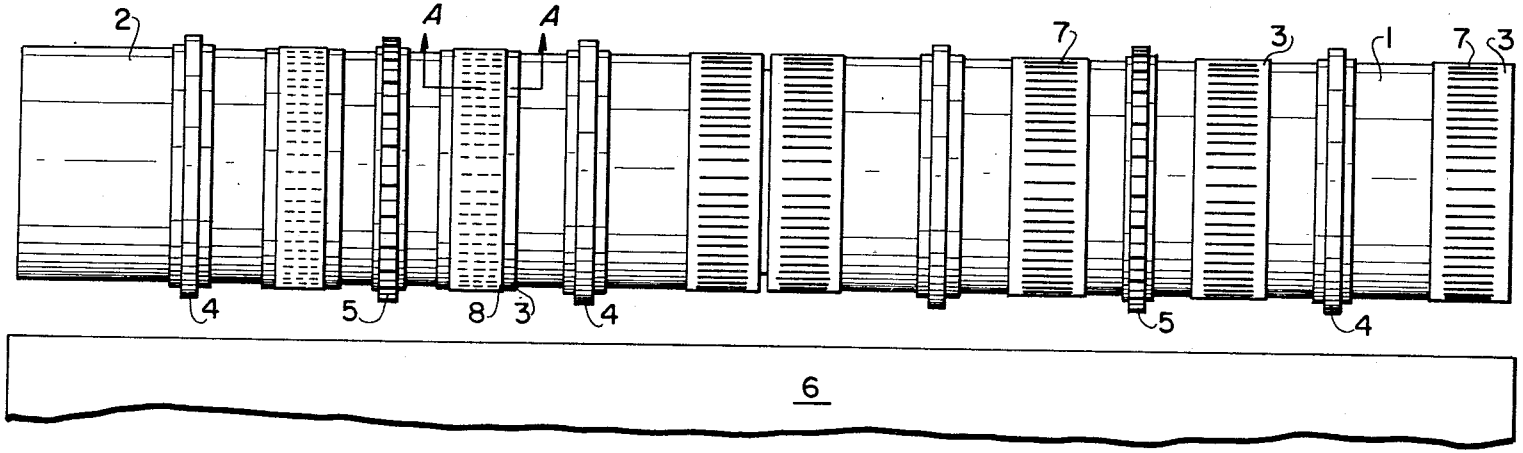
FIG. 1 is a view in elevation of the decorticating drum.

As noted from FIG. 1, a decorticating drum is shown in elevation. It is composed of a drum 1 designed for dry debarking and of a drum 2 for wet debarking. These two drum parts are joined into an overall decorticating drum. Structures with support rollers (not shown) rest on the foundation 6 and support the entire decorticating drum. The tires 4 resting in the support rollers are provided at the drum 1 and 2. The spur gears 5 driving the drum are located between these tires. As a rule, the drum is composed of a tubular part with recurring longitudinal slots 7 evenly distributed over the circumference being advantageously provided. In order not to unduly weaken the drum in this region, the reinforcing rings 3 are added and mounted over the slots 7. Thereby, the stresses are uniform throughout the entire drum. The longitudinal slots 7 are indicated by dashed lines at drum 2, i.e., at the wet debarking side, to indicate that this location is sealed by a cover 8.

Figure 2:
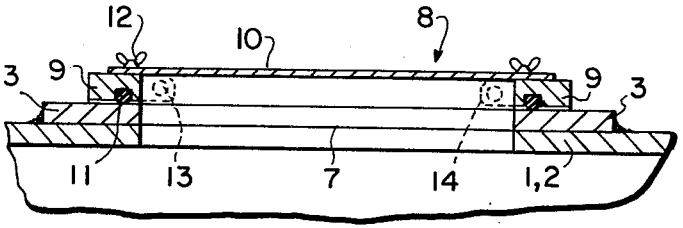
FIG. 2 is a cross-section of the cover assembly.

FIG. 2 is a cross-section on an enlarged scale of the section shown as A—A in FIG. 1, namely the sealing of the decorticating drum 1, 2 in the region of the longitudinal slots 7 by the covers 8. Also, a pair of rings 9 are mounted above the drum 1 or 2 beyond the length of longitudinal slots 7. This pair of rings 9 is assembled in known manner by a screw connection 13. To better seal the pair of rings 9, a groove is provided on the interior thereof, in which is inserted an 0-ring 11. One part of the pair of rings 9 is not composed of an endless annulus, rather it is preferably assembled from two semi-circles which can be placed like a clamp around the drum 1 or 2. The flanges 14 are provided at the ends of the semicircles, penetrate somewhat into the region of the longitudinal slots 7, and are solidly connected to each other by the screws 13. This will ensure that the pair of rings 9 rests firmly and sealingly against the drum 1, 2. The bolt and wing nut connections 12 furthermore are mounted to the pairs of rings 9, to permit fastening the seal 10, for which purpose a quick-connect means also may be used. Thereby the composite cover 8 is now obtained. It will be advantageous to design the seal 10 to be a third or a fourth of the arc of the outer periphery of the pair of rings 9 and to provide for interchangeability. The longitudinal slots 7 are shown in the reinforcing ring 3.

This special decorticating drum with selective mode of processing therefore allows easy switching of the mode of operation depending upon the material to be decorticated, and is applicable to any type of wood decortication.

It will be obvious to those skilled in the art that many modifications may be made within the scope of the present invention without departing from the spirit thereof, and the invention includes all such modifications.

What is claimed is:

1. In a decorticating drum with a selective mode of processing, composed of a hollow cylinder adapted to rotate about its longitudinal axis, and being adapted to receive wood fed in at one end and discharge it at the other, in particular a decorticating drum for dry debarking including longitudinal slots at the surface thereof for the elimination of the bark, shell-like cover means adapted to be mounted to the outer surface of the drum in the region of the longitudinal slots whereby a wet decorticating drum is formed, and said cover means being detachable whereby a dry decorticating drum is formed, the improvement comprising slotted reinforcing ring means secured to said drum surface over the slots in the latter, a pair of supporting ring means secured to said reinforcing ring means adjacent said slots, groove means in the surface of said supporting ring means facing said reinforcing ring means, O-ring means in said groove means, and seal means adapted to be connected to said pair of supporting ring means.

2. A decorticating drum according to claim 1 in which the seal corresponds to about a third or a fourth of the arc of the pair of rings.

3. A decorticating drum according to claim 1 in which the pair of rings each is composed of two semi-arcs, said pair of rings being clamped around the drum by means of screw means and flange means.

* * * * *